United States Patent [19]

Soldavini

[11] 4,006,896

[45] Feb. 8, 1977

[54] TENNIS RACKET

[76] Inventor: Alfred C. Soldavini, Fairmount Road, East Pottersville, N.J. 07979

[22] Filed: July 10, 1975

[21] Appl. No.: 594,794

[52] U.S. Cl. ..... 273/73 J; 273/75

[51] Int. Cl.[2] ..... A63B 49/08

[58] Field of Search ..... 273/26 R, 26 B, 29 R, 273/29 A, 58 R, 58 K, 60 R, 60 A, 65 R, 72 R, 73 R, 73 J, 75, 81 R, 81 B, 81 D, 81.4–81.6, 165, 163 A; 35/29 R

[56] References Cited

UNITED STATES PATENTS

| | | | |
|---|---|---|---|
| 412,479 | 10/1889 | Davis | 273/75 X |
| 1,126,208 | 1/1915 | Hayford | 273/163 A |
| 1,917,236 | 7/1933 | Bloomstrand | 273/75 X |
| 2,091,512 | 8/1937 | Marsh | 273/81.4 |
| 2,177,143 | 10/1939 | Lamkin | 273/81.6 |
| 2,448,731 | 9/1948 | Park | 273/60 A |
| 2,628,100 | 2/1953 | Beebe | 273/81.4 |
| 2,865,635 | 12/1958 | Jessen | 273/163 A X |
| 2,925,273 | 2/1960 | Pratt | 273/26 R |
| 3,370,851 | 2/1968 | Murray | 35/29 R X |
| 3,534,960 | 10/1970 | Hanks | 273/75 |
| 3,848,874 | 11/1974 | Elkins | 273/81 B X |
| 3,868,110 | 2/1975 | Jones | 273/75 |
| 3,905,598 | 9/1975 | Ballog | 273/75 |

FOREIGN PATENTS OR APPLICATIONS

| | | | |
|---|---|---|---|
| 762,059 | 1/1934 | France | 273/75 |
| 211,792 | 2/1924 | United Kingdom | 273/75 |
| 369,888 | 9/1930 | United Kingdom | 273/75 |
| 407,270 | 3/1934 | United Kingdom | 273/75 |

*Primary Examiner*—Richard J. Apley
*Attorney, Agent, or Firm*—Roger A. Clapp

[57] ABSTRACT

An improved tennis racket is disclosed which includes strings, a frame holding the strings in a common plane, a handle attached to the frame and marking indicia on the handle for insuring proper indexing between the common plane and the player's hand which grips the handle. The marking indicia comprises various combinations of finger grooves cut in the handle surface, bumps or other surface irregularities sensitive to palpation and aligning marks cut into, raised from or painted on the handle surface.

6 Claims, 6 Drawing Figures

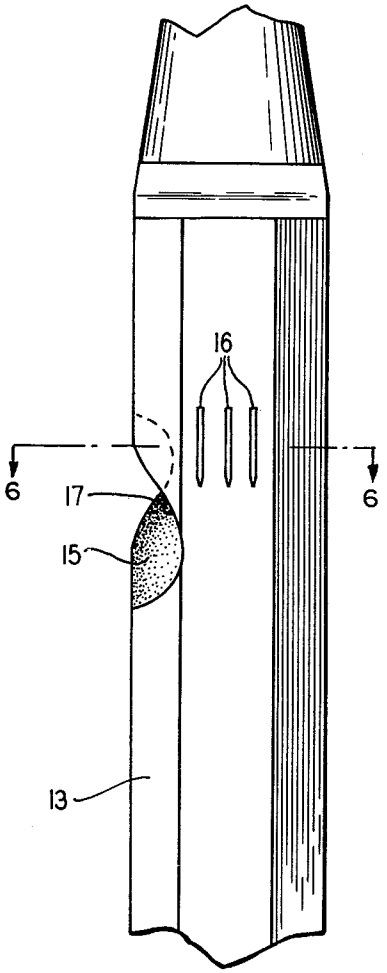
FIG. 5
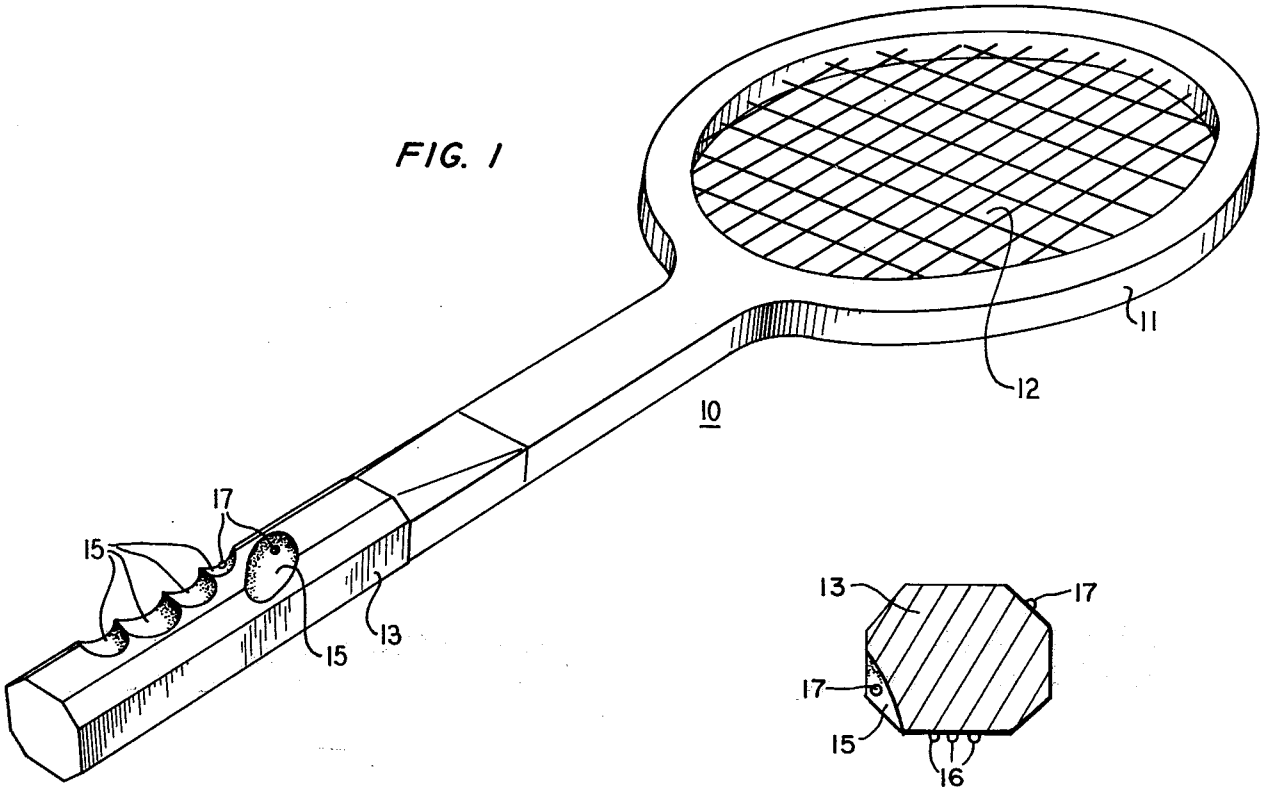
FIG. 1
FIG. 6

TENNIS RACKET

BACKGROUND OF THE INVENTION

1. Field of the Invention

This invention relates to tennis rackets and pertains in particular to those which are adapted to aid a player in maintaining a proper grip on the handle.

2. Description of the Prior Art

It is elementary that the position of the tennis racket is critical when it meets the ball. That position is determined by the player's grip and with beginning players it is difficult to be sure that the racket is always being held in the correct position. Moreover, the newer player often forgets what he has been shown and permits his grip to become improper. As a consequence, the beginning player fails to achieve consistency in his grip and progress towards proficiency is delayed.

Accordingly, one object of this invention is to assist a player in maintaining a proper grip at all times.

Another object of this invention is to provide the player with a ready reference to the proper grip as playing conditions change.

Still another object of this invention is to facilitate marketing of the tennis racket.

SUMMARY OF THE INVENTION

In accordance with a preferred embodiment of this invention, maintenance of the proper grip is facilitated by equipping the racket handle with means for indexing the point of junction between the thumb and forefinger of the player's racket gripping hand with respect to a plane containing the racket strings.

In accordance with one feature of this invention, the indexing means includes grooves for accepting the players fingers so as to insure the proper juxtaposition between hand and racket handle.

In accordance with another feature of this invention, the indexing means includes indicia for identifying the proper position of the player's fingers in the grooves as conditions of play change.

In accordance with still another feature of this invention, the indicia comprises references palpable to the player.

A better understanding of these and other objects and features of this invention will be facilitated by a review of the following drawing and detailed specification.

BRIEF DESCRIPTION OF THE DRAWING

FIG. 1 is a perspective view of a tennis racket having a handle equipped with finger accepting grooves.

FIG. 5 is top elevation of a portion of the handle shown in FIG. 3 and is enlarged to more clearly illustrate the indexing indicia thereon.

FIG. 6 is an end elevation view of the handle shown in FIG. 3 taken in section but modified to illustrate an alternate form of indexing indicia.

DETAILED DESCRIPTION OF THE INVENTION

Figure 3:
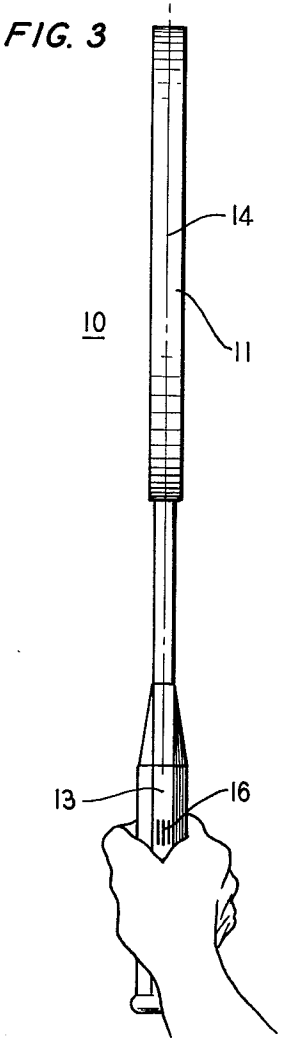
FIG. 3 is a top elevation view of the embodiment illustrated in FIG. 1 and illustrates one form of indexing indicia located in close proximity to a thumb groove.
Figure 2:
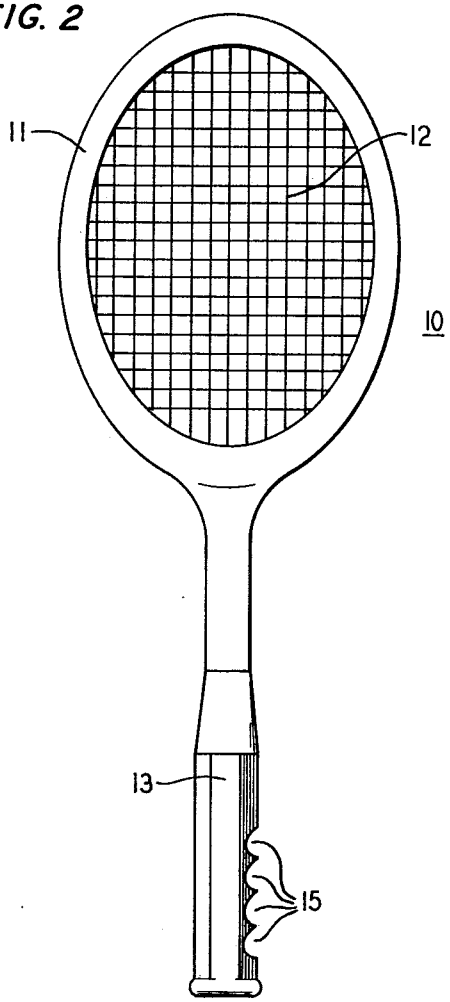
FIG. 2 is a front elevation view of the racket shown in FIG. 1 and illustrates the finger grooves.

Referring to FIG. 1, a racket 10 is illustrated which comprises a frame 11, strings 12 and a handle 13. The frame 11 and handle 13 are joined together in a single rigid construction and the frame 11 holds the strings 12 in a matrix pattern such that the strings lie in a common plane 14.

The handle 13 contains a set of grooves 15 which accomodate the tennis player's fingers. In the embodiment shown, the grooves 15 are adapted for a right handed player. The grooves can be created in various ways, but it is anticipated that the most convenient is to cast the handle out of a plastic material in a mold modified to produce the desired grooves.

The grooves 15 are primarily functional, but it is anticipated that they will assist in marketing the racket. For example, the molds can be made from hands of famous players to create a line of rackets. Thus, any player can choose his racket to have grooves which correspond to the grip of his favorite player. Moreover, the handle can be filled with a setting material similar to that used in ski boots so that a tailored grip can be achieved.

The grooves 15 also cooperate with indicators to index the players hand position with respect to the racket handle during play. In the embodiment illustrated in FIGS. 3 and 5, the indicator comprises a set of guide marks 16 which are intended to index the player's hand with respect to the plane 14 thereby making certain that the face of the strings 12 will be properly aligned with respect to the ball.

The guide marks 16 may be painted or inscribed on the handle 13. Similarly, they may be in the form of of raised ridges which can be created during the molding process or the like.

In the embodiment shown in FIG. 3, the player's fingers are oriented in the grooves 15 so that the point of junction between the thumb and forefinger is aligned with the middle mark. In that position, the hand automatically assumes the continental back and forehand position. When the fingers are shifted in the grooves 15 so that the hand rotates clockwise, as viewed in FIG. 3, the point of junction between the thumb and forefinger lines up with the right-most mark and the hand will automatically assume the eastern forehand position. Similarly, shifting the fingers in the groove 15 so that the hand rotates counterclockwise until the point of junction between the thumb and forefinger lines up with the left-most mark will automatically place the hand in the proper position for the eastern backhand. Thus, the grooves 15 and guidemarks 16 cooperate to position the player's hand readily and quickly as play dictates.

Figure 4:
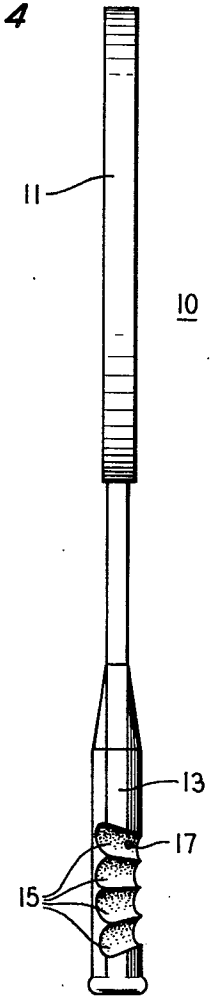
FIG. 4 is a bottom view of the embodiment illustrated in FIG. 1 and shows the extension of the finger grooves shown in FIG. 2.

In FIGS. 1, 4 and 5, alternative or supplementary indexes are disclosed in the form of surface irregularities comprising protuberances or bumps 17. Advantageously, the bumps 17 are located in the grooves 15 which are adapted to accept the thumb and forefinger of the player's hand. They are raised sufficiently from the surface so as to provide a palpable indication of finger position.

It will be recognized that the bumps 17 can be used alone, in combination with the grooves 15 or, as illustrated in FIG. 6, in combination with the guidemarks 16, the grooves 15 or various combinations of both. When used in combination with the guidemarks 16, the player will receive sensory reminders from two independent sources; that is, physical as well as visual. This is particularly valuable to the beginning player because he all too often forgets the proper hand position after his lessons are over. By providing both visual and tactile sensing, however, the player can quickly adapt to one or the other alone. Moreover, the incessant corrective function of the indicia will cause most players to quickly assume the habit of proper hand position.

In summary, a system of indexing a player's hand to his racket has been disclosed which will assist a player in maintaining a proper grip at all times. Moreover, the system will provide the beginning player with a ready reference to the proper hand grip for varying playing conditions so that he can more rapidly progress in his technique. While only a preferred embodiment of the invention has been disclosed, it is merely illustrative of the principals of the invention and many others falling within the scope of the invention will readily occur to those skilled in the art.

What I claim is:

1. A tennis racket having a string matrix disposed in a common plane and held in position by a frame to form a surface for striking a tennis ball, an extended handle linking said strings to a player's hand and indexing means on said handle for positioning the junction point between the player's thumb and forefinger with respect to said common plane characterized in that said indexing means includes at least one raised surface irregularity and a set of lines parallel to the long axis of said handle, said parallel lines being disposed on the surface of said handle in a predetermined position with respect to said common plane so as to cooperate with the point of junction between a holder's thumb and forefinger and said surface irregularity being disposed on said handle to engage at least one gripping finger of a holder's hand.

2. A tennis racket in accordance with claim 1 wherein said surface irregularity is adapted to engage a player's forefinger when his hand grips said handle.

3. A tennis racket in accordance with claim 2 further including a second surface irregularity adapted to engage a player's thumb when his hand grips said handle.

4. A tennis racket in accordance with claim 2 wherein said indexing means further includes grooves for accommodating the fingers of a player's hand.

5. A tennis racket in accordance with claim 4 wherein said surface irregularity is located in said grooves.

6. A tennis racket in accordance with claim 3 wherein said surface irregularities are disposed in grooves recessing the surface of said handle.

* * * * *